United States Patent [19]

Shirey

[11] Patent Number: 4,545,170

[45] Date of Patent: Oct. 8, 1985

[54] EXPANDED METAL PRODUCTS

[75] Inventor: Richard Shirey, Avon, Ohio

[73] Assignee: Donn Incorporated, Westlake, Ohio

[21] Appl. No.: 563,995

[22] Filed: Dec. 21, 1983

[51] Int. Cl.[4] ..... E04C 2/42

[52] U.S. Cl. ..... 52/670; 52/673; 29/6.1; 29/557; 428/595; 428/597

[58] Field of Search ..... 52/670, 671, 662, 663, 52/674, 675, 673; 29/6.1, 557; 428/120, 595, 596, 597

[56] References Cited

U.S. PATENT DOCUMENTS

| | | | |
|---|---|---|---|
| 738,825 | 9/1903 | Mallory . | |
| 1,763,940 | 6/1930 | Wallen . | |
| 1,953,657 | 4/1934 | Pierce | 52/675 |
| 1,964,403 | 6/1934 | Loucks | 189/34 |
| 2,052,024 | 8/1936 | Hahn | 72/115 |
| 2,142,637 | 1/1939 | Faber | 189/34 |
| 3,112,533 | 12/1963 | Haver | 52/675 X |
| 3,279,043 | 10/1966 | Wirt | 428/596 X |
| 3,287,873 | 11/1966 | McDill | 52/675 |
| 3,333,379 | 8/1967 | Harris | 52/364 |
| 3,737,964 | 6/1973 | Jury | 29/152 |
| 4,021,985 | 5/1977 | Deaton | 52/662 X |
| 4,478,901 | 10/1984 | Dickens et al. | 428/120 |

*Primary Examiner*—Carl D. Friedman
*Assistant Examiner*—Creighton Smith
*Attorney, Agent, or Firm*—Pearne, Gordon, Sessions, McCoy, Granger & Tilberry

[57] ABSTRACT

A novel and improved, expanded metal is disclosed along with novel and improved products incorporating such expanded metal. The expanded metal is formed from a piece of sheet metal which is lanced in nested arrays so that when the metal is expanded, diagonal legs are connected to the remaining portion of the sheet metal by folds. After the expanding operation, the legs are substantially coplanar with the adjacent portions of the piece of sheet metal, and the only material deformation of the metal occurs along the folds. The illustrated legs and adjacent projections, which are connected to the legs by folds, are curved so that the centers of the legs have a maximum width. The expanded metal is illustrated incorporated into various types of framing members used to position interior panels of building structures, such as drywall studs, floor tracks for drywall construction, and intersection tracks. Also disclosed are grid tees for suspension ceilings and wall molding members for suspension ceilings.

34 Claims, 12 Drawing Figures

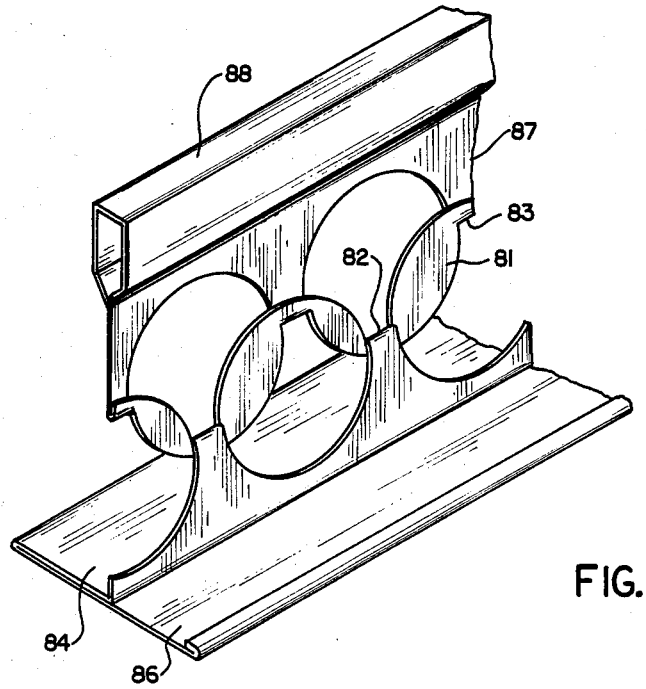
FIG. 10
FIG. 12
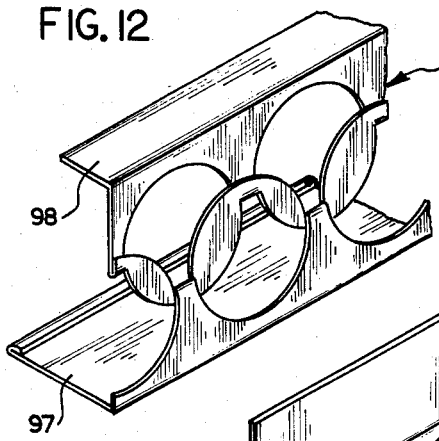
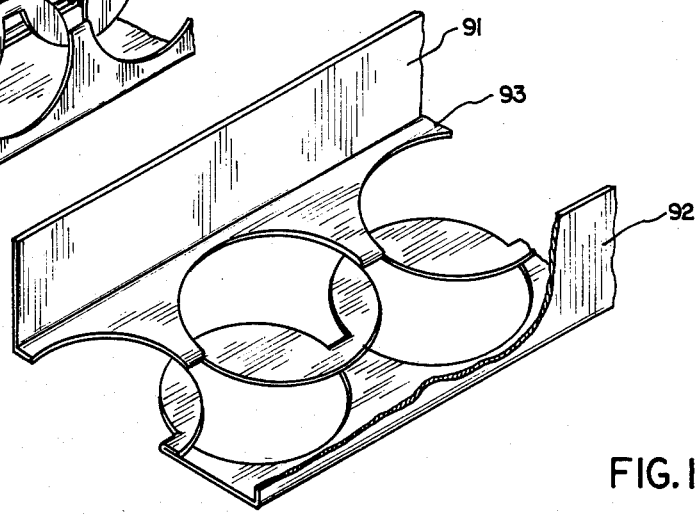
FIG. 11

EXPANDED METAL PRODUCTS

BACKGROUND OF THE INVENTION

This invention relates generally to expanded metal products, and more particularly to a novel and improved, expanded metal and to novel and improved products made from such expanded metal.

PRIOR ART

It is known to provide beams and other structural products with expanded metal portions to reduce the metal required to produce the product. Examples of such products are illustrated in U.S. Pat. Nos. 1,763,940; 1,964,403; 2,142,637; and 3,737,964.

It is also known to produce studs for buildings and furring channels having expanded metal webs, as illustrated in U.S. Pat. Nos. 2,052,024 and 3,333,379.

In most instances, such products have not gained significant commercial acceptance. Such lack of acceptance, it is believed, has resulted from the fact that the expanded metal structures usually require substantial stretching of the metal and the metal often fractures or tears where adjacent legs join. Consequently, the expanded metal structure is not sufficiently stable and is considerably weakened and is ineffective in transmitting loads, particularly compressive and bending loads. In fact, in the U.S. Pat. No. 1,763,940, supra, the weakness of the expanded metal in the web of an I-beam is apparently recognized and struts are installed at intervals along the length of the beam to serve as compressive members to space the beam flanges.

It is also known to produce a type of expanded metal in which the legs are not stretched during the expansion of the metal. The material forming such expanded metal is bent or folded during the expansion thereof. Such expanded metal is illustrated in U.S. Pat. No. 738,825. Such patent provides legs joined at loose folds, and indicates that the expanded metal is intended for fencing where compressive or bending loads are not normally encountered. In fact, in such expanded metal, because the folds are loose and not fully closed, the plane of each array of legs is inclined with respect to the planes of the adjacent arrays, so any attempt to apply material compressive loads between adjacent arrays tends to cause collapse of the array. Further, because the legs are relatively long and narrow and extend at a substantial angle with respect to each other, they provide a relatively unstable structure.

SUMMARY OF THE INVENTION

In accordance with one aspect of the present invention, a novel and improved expanded metal structure is provided. The expansion of such metal is accomplished without stretching or tearing of the metal, and provides arrays of legs which remain substantially in their original condition and shape. The expansion is achieved by folding the metal without producing material weakness at such folds. Further, the folds are fully closed so that the arrays of legs are substantially coplanar. Therefore, an expanded metal having improved stability is provided.

In the preferred embodiment, the expanded metal is formed from sheets of metal cut or lanced with a pattern of overlapping curves, which, in the illustrated embodiment, are portions of circles. Such patterns provide relatively short legs for the amount of expansion. The short legs provide higher strength and improved stability of the expanded metal and the products manufactured therefrom. Further, the overlapping curved pattern provides legs which are relatively wide at their center, and such structure is material-efficient, since such wide portions are positioned in most instances at the midpoint of the products incorporating the expanded metal, and extend along the location of maximum bending stress. Additionally, the included angle between adjacent legs may be relatively small with the overlapping circular design. The illustrated spacing produces an included angle of approximately 70 degrees between adjacent legs. Such arrangement provides good, efficient load-carrying capacity.

In accordance with another aspect of this invention, a novel and improved sheet metal stud of the type used in drywall construction is provided. Such stud is generally U-shaped, providing spaced and substantially parallel flanges which attach directly to the drywall panels and a web of expanded metal in accordance with this invention joining the flanges. Because the expanded metal is highly stable and is capable of handling substantial compressive and bending forces, with the illustrated structure the web functions to properly maintain the flange position both during the erection of the panels and studs and after the wall structure is completed.

In accordance with still another aspect of this invention, a novel and improved ceiling grid is provided which utilizes expanded metal, resulting in material savings. Here again, the stability provided by the expanded metal portion of the grid members renders the system satisfactory for conventional use while permitting savings in the material required to produce the grid members.

In accordance with still another aspect of this invention, a novel and improved wall bracket is provided which incorporates expanded metal to reduce material costs in the production of such brackets.

In accordance with a further aspect of this invention, a novel and improved floor and ceiling channel structure is provided for drywall construction. Again, such generally U-shaped channels provide expanded metal webs to reduce material costs and parallel flanges interconnected by such webs.

Further aspects of this invention are illustrated in the accompanying drawings, and are more fully described in the following specification.

BRIEF DESCRIPTION OF THE DRAWINGS

FIG. 10 is a fragmentary, perspective view of a suspension ceiling grid tee providing an expanded metal web in accordance with this invention;

FIG. 11 is a fragmentary, perspective view of a floor track providing an expanded metal web in accordance with this invention; and FIG. 12 is a fragmentary, perspective view of a wall bracket for a suspension ceiling incorporating an expanded metal web in accordance with the present invention.

DETAILED DESCRIPTION OF THE DRAWINGS

Figure 1:
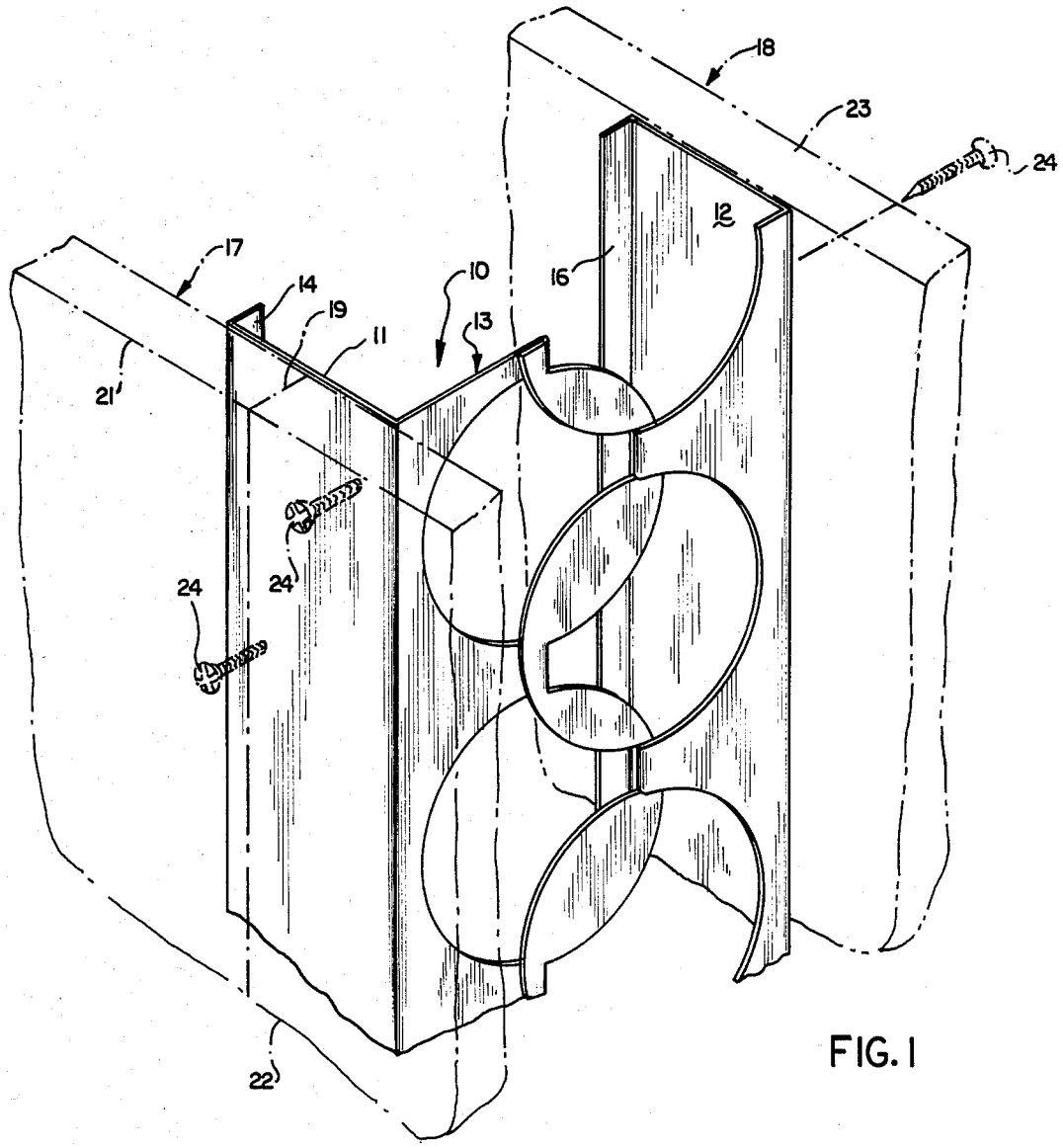
FIG. 1 is a fragmentary, perspective view of a metal drywall stud providing an expanded metal web structure in accordance with the present invention.
Figure 4:
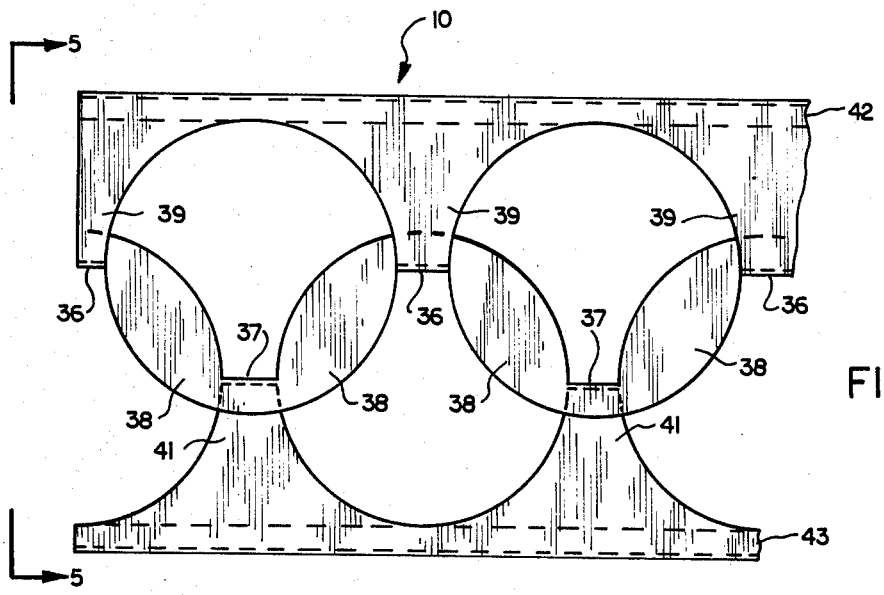
FIG. 4 is a side elevation of the stud of FIG. 1 which is finish-formed from the expanded metal strip of FIG. 3.

FIGS. 1 through 5 illustrate a preferred embodiment of a sheet metal drywall stud in accordance with this invention. Such stud 10 includes a pair of opposed, parallel flanges 11 and 12 which are interconnected by an expanded metal web 13. At the extremities of the flanges 11 and 12, remote from the web 13, the metal forming the stud is bent inwardly to provide short stiffening tabs 14 and 16.

Except for the fact that the web is formed of expanded metal as discussed in detail below, such a stud is conventional in structure and is installed between parallel rows 17 and 18 of wall panels which may be, for example, drywall panels. Such panels are illustrated in phantom in FIG. 1. In a typical installation, a joint 19 is provided between two edge-abutting panels 21 and 22, with the joint being located substantially midway along the width of the flange 11, and the flange 12 is secured to the panel 23 at a point spaced from the edges of such panel. Additional studs are generally located at the joints between the panel 23 and the next adjacent panels in the row 18.

The various panels are secured to the flanges by any suitable means, which may include sheet metal fasteners 24, which are driven through the panels and into the flanges to secure the panels to the flanges. In some instances, adhesive may be used to secure the panels to the flanges. However, when sheet metal screws 24 are used to secure the panels in place, it is customary to use a screw of the type which does not require a predrilled hole and which actually cuts or pierces a hole in the associated flange and then threads its way into the hole to form a threaded connection between the metal of the flange and the screw.

During the driving of the screw into its installed position, it is customary to use a power drive and to exert a substantial axial force on the screw so that it will form its own hole in the flange and thread itself into the hole thus formed. This axial force, because it is offset from the plane of the web 13, exerts both compressive and bending forces on the web, creating stresses therein both in compression and bending. Consequently, the web 13 must provide sufficient stability or stiffness to be capable of withstanding such forces, at least during the initial driving of the screws.

Some deflection of the web during the actual driving operation is permissible; however, the material forming the web should not be stressed beyond its elastic limit so that once the screws are seated and the flanges returned to a parallel condition against the associated panels, the web 13 remains substantially planar and, in the illustrated embodiment, is contained in a plane perpendicular to the plane of the panels on each side of the stud. When the web components remain substantially planar, the stud is capable of resisting substantial forces against the wall panels without failure.

In an installed wall in which the stud flanges are secured to the panels, the panels themselves tend to hold the flanges parallel, with the result that forces applied to the wall panels are transmitted to the web which are substantially compressive or tensile in nature, and such forces do not usually result in the application of significant bending forces to the web. Consequently, the most significant stresses on the web 13 after the stud is installed are either in compression or tension.

Figure 2:
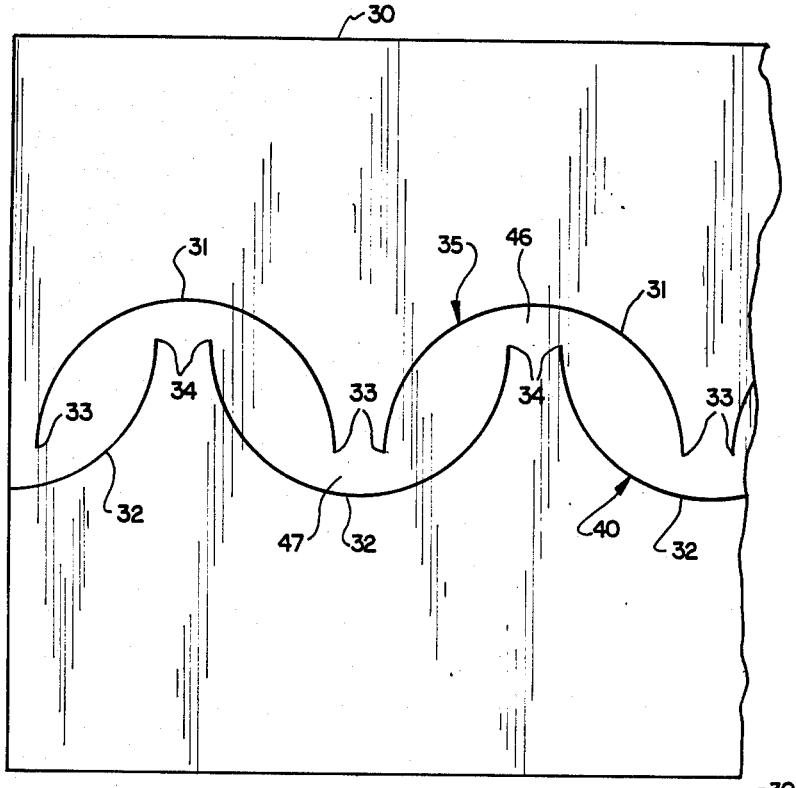
FIG. 2 is a fragmentary view of a strip of sheet metal which may be used to form the stud of FIG. 1 in its flat condition after it is lanced to permit expansion thereof but prior to the actual expanding operation.
Figure 3:
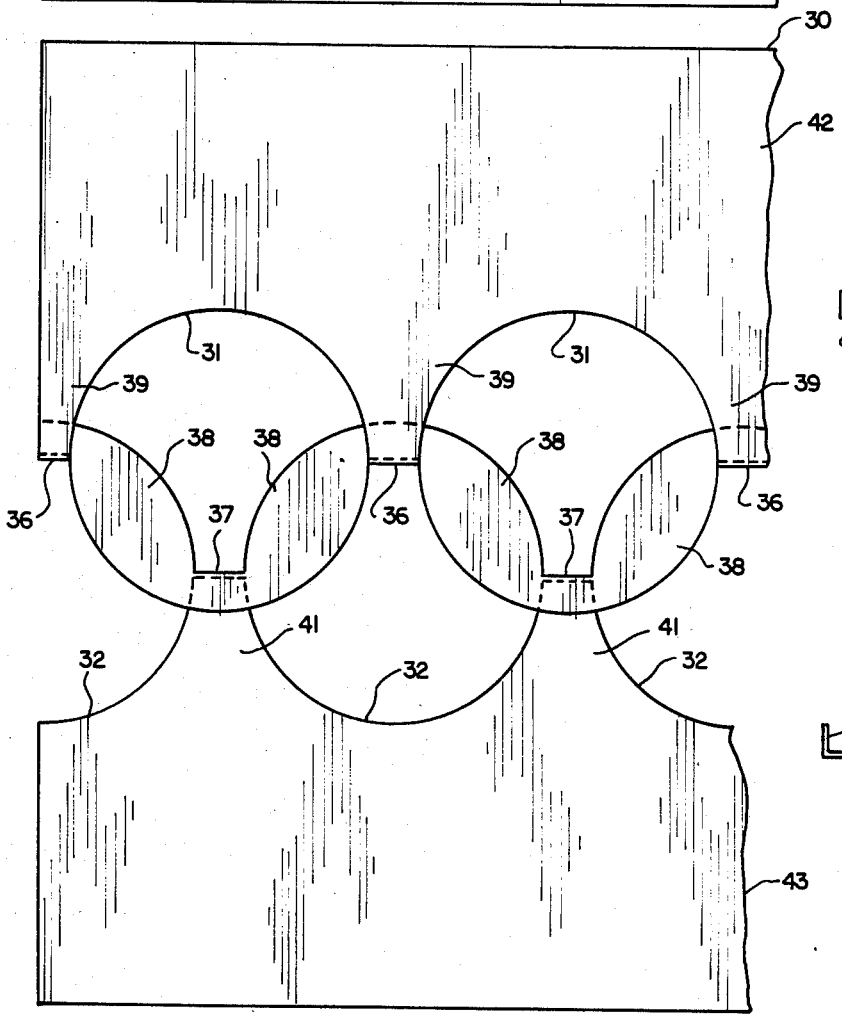
FIG. 3 is a fragmentary view of the strip of metal of FIG. 2 after the expanding operation.

Reference should now be made to FIGS. 2 and 3, which illustrate the manner in which the material forming the web is expanded to reduce the material content of the web and thereby reduce the material cost of the stud.

FIG. 2 illustrates a portion of the strip of metal 30 used to form the stud 10. Such strip of metal is lanced along overlapping curves 31 and 32, which in the illustrated embodiment are portions of circles of equal radius. The curved lances 31 form a first array 35 of aligned lances extending to ends 33 which are spaced from the adjacent ends 33 and are centrally located within the curved lances 32 but spaced therefrom. Similarly, the curved lances 32 are aligned and form an array of lances each of which extends to an end 34, which are again spaced from each other and are positioned within the curves 31 but spaced therefrom. The spacing between the ends 33 and the ends 34 is equal, and the spacing between the ends 33 and 34 from the curves 32 and 31, respectively, is equal.

After the strip 30 is lanced with the two arrays of lances, the material forming the strip 30 is expanded by folding the material along fold lines 36 and 37. The fold lines 36 extend between the ends 33 of the lances 31 and the fold lines 37 extend between the ends 34 of the lances 32. The folding of the material causes the material along the fold lines to be bent through 180 degrees, and after the folding or bending operation is completed, the strip of material 30 assumes the condition illustrated in FIG. 3. It should be noted that in such condition, the strip of metal 30 has been laterally expanded a considerable amount. After the expansion of the metal by the folding operations, the portions of the metal between adjacent parts of the lances 31 and 32 provide an array of legs 38 and lateral projections 39 and 41. The projections 39 are formed by the portions of the material between the lances 31 and the projections 41 are formed by the material between the lances 32. The legs 38 extend between adjacent folds 36 and 37, and provide an angulated bridging connection between the two sides 42 and 43 of the expanded metal. When the lances are curved as illustrated, the projections 39 and 41 have concave curved edges and the legs 38 have convex curved edges which match the curved edges of the projections.

After expansion, the folds 36 are aligned with each other and parallel to the line of folds 37. During the expansion operation, the material forming the sheet 30 is not deformed to any material extent except at the folds 36 and 37. Therefore, the expansion of the metal does not create stresses, tears, or other weakening conditions so long as the metal thickness and properties are selected so that the metal can be bent through 180 degrees without appreciable weakening at the fold line.

In the embodiment of FIGS. 1 through 4, the flanges 11 and 12 and the stiffening ribs 14 and 16 are formed subsequent to the expanding operation. However, it is within the broader scope of this invention to form the bends to produce such flanges and tabs prior to the lancing and expanding of the metal.

Figure 5:
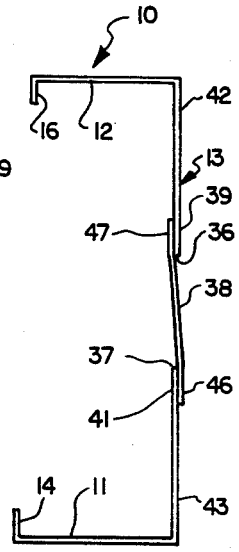
FIG. 5 is an end view of the stud, taken along line 5—5 of FIG. 4.

As best illustrated in FIG. 5, the folds at 36 and 37 are tightly formed so that the portion of the material 46 and 47 originally existing between the ends of the lances of one array and the adjacent portions of the lances of the other array extends back along the associated projecting portions 39 and 41 in substantially full contact therewith. Therefore, the overlapping portions provide two layers in engagement with each other. In fact, it is preferred to overbend each of the folds to ensure good contact along such overlapping portions.

When the folds are tightly formed in this way, the plane of the legs 38 is substantially coplanar with the plane of the unexpanded portions 42 and 43 on either side of the expanded portion of metal. In the drawings, the thickness of the metal is exaggerated somewhat for purposes of illustration, but a drywall stud would normally be formed of metal having a thickness in the order of 0.022 inch, so the legs 38 and the remaining portions of the web are virtually coplanar and the expanded metal web is capable of resisting collapse even when subjected to substantial compressive forces. Further, such a web is also able to withstand substantial bending stress without permanent deformation and provides sufficient stability to absorb the forces applied to the flanges during the operation of driving the screws 24.

Referring to FIG. 5, if a screw is driven into the flange 11 to the left of the plane of the web 13, it produces in the web a bending moment tending to open the fold 37. Therefore, the length of the folds should be selected to provide sufficient strength to prevent appreciable opening of the fold under the bending stresses expected to be encountered. On the other hand, in such embodiment such bending stresses applied to the flanges 12 do not tend to open the fold 36 because the stresses are in a direction tending to further close the fold, which is resisted by the portion 47.

Bending stresses, however, resulting from inward forces applied to either flange do tend to cause bending of the legs 38. With the preferred form illustrated in which the legs are curved, the legs 38 have a maximum width along the centerline of the web which is the point of maximum stress when bending forces are applied. Therefore, this preferred embodiment, in which the lancing is along curved lines, provides very efficient material usage and relatively high strength to resist bending failures of the stud.

Further, it is desirable to arrange the legs so that they are relatively short and are inclined with respect to each other so as to provide a relatively small included angle. Such angle is preferably less than 90 degrees, so as to provide a high degree of stability. When increased stability is required, the portions 46 and 47 may be suitably connected to the associated projections 39 and 41 so as to resist bending of the projections in their thinnest area or opening of the folds. Such connection may be in any suitable manner, and can, for example, be provided by an adhesive located between the overlapping portions, or by other suitable means such as welding, soldering, fasteners, or lance stitching, as illustrated in U.S. Pat. No. 4,394,794. Such patent is incorporated herein by reference to illustrate such lance stitching.

Although not necessary in all instances, it is generally desirable when a bend is required, for example, to produce the flanges 10 and 11, to form the bend along the portions 42 and 43 which are not cut out during the expanding process.

Figure 6:
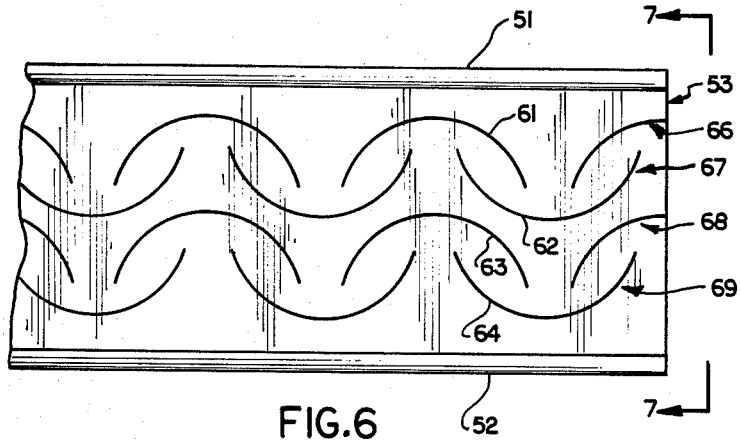
FIG. 6 is a plan view of an intersection track lanced with a double pattern prior to the expansion of the metal forming the web thereof.
Figure 7:
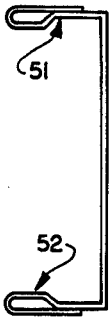
FIG. 7 is an end view taken along line 7—7 of FIG. 6.
Figure 8:
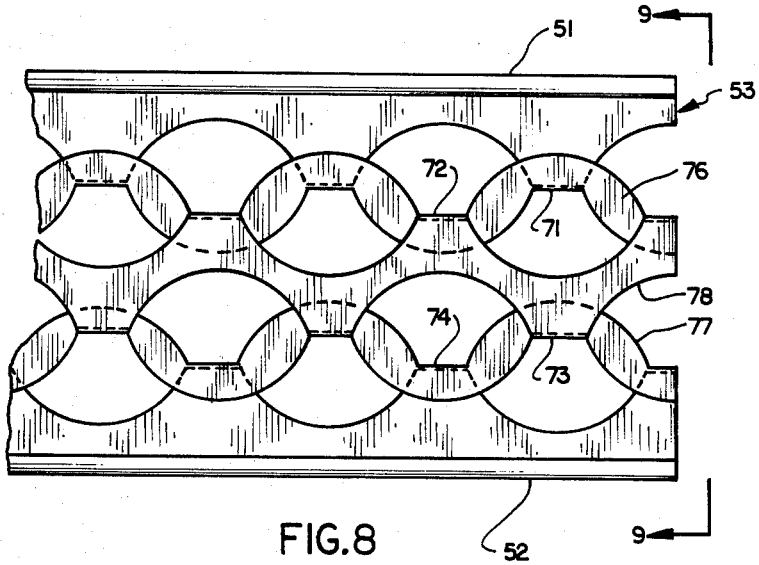
FIG. 8 illustrates the finished track of FIG. 6 after the metal is expanded.
Figure 9:
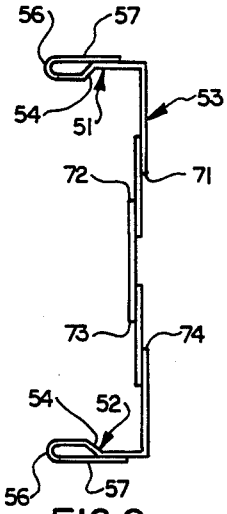
FIG. 9 is an end view taken along line 9—9 of FIG. 8.

FIGS. 6 through 8 illustrate a channel-shaped member formed with an expanded metal web having multiple arrays of legs. Such a member is often used at the intersection between two walls.

Such expanded metal may be used in some products in which a greater amount of expansion is required and where the stresses applied to the products are not as severe. Such an arrangement, however, does provide a high degree of stability when compared to typical expanded metal.

In this embodiment, the channel member again provides a pair of laterally spaced, substantially parallel flanges 51 and 52 which are joined by an expanded metal web 53. In the particular embodiment illustrated, the flanges are provided with an offset at 54 and a reverse bend at 56 so that the edges of the metal forming the channel extend back along the portions 57 toward the web 53. In this particular embodiment, the flanges 51 and 52 are formed prior to the expansion of the metal of the web 53.

As best illustrated in FIG. 6, the web 53 is lanced along arrays of curves 61, 62, 63, and 64. The lances 61 through 64 are each portions of curves or circles having the same radius of curvature. The lances 61 cooperate to form a first array 66 extending lengthwise of the web. The lances 62 nest with the lances 61 and form a second array 67. Similarly, the lances 63 and 64 respectively form arrays 68 and 69.

After the lancing operation, the material forming the web is folded between adjacent ends of adjacent lances within each array to expand the web to the condition illustrated in FIG. 8. During the expansion, a plurality of aligned folds 71 are provided at the adjacent ends of the curved lances 61. Additional folds 72, which are aligned with each other and parallel to the line of folds 71, are formed between the adjacent ends of the curved lances 62. Similarly, folds 73 are provided between the ends of the curved lances 63 and folds 74 are provided between the ends of the curved lances 64. With this multiple lancing embodiment, a first array of curved legs 76 diagonally connects between the folds 71 and 72 and a similar array of curved legs 77 connects between the folds 73 and 74. Each of the arrays 76 and 77 is widest at its midpoint in a manner somewhat similar to the embodiment of FIGS. 1 through 5. A center array of projections 78 interconnects the folds 72 and 74. In this instance, the edges of the lateral projections 78 of the array are concavely curved. Because multiple arrays of interconnecting legs are provided, this embodiment does not provide the same degree of stability as the embodiment of FIGS. 1 through 5, but may be used to produce products which are not subjected to as high stress. For example, the particular channel illustrated in FIGS. 6 through 9 is an intersecting channel normally installed at the intersection between two walls. In such installation, the web 53 is mounted directly on a wall and is supported thereby. Further, if inward forces are applied to either flange, the bending stresses are in a direction tending to close the bends 71 or 74, as the case may be. Therefore, the overlapping portions adjacent to such bends provide additional strength to resist such stresses. Here again, the material of the expanded metal web is not distorted appreciably during the expanding operation and the various portions are again substantially coplanar. Here again, for purposes of illustration, the thickness of the metal has been exaggerated and is normally such that the various parts of the web are virtually coplanar.

FIG. 10 illustrates a typical grid tee for use in suspension ceiling grid systems formed with an expanded metal web in accordance with this invention. In this instance, the web is expanded with the same structure as the embodiment of FIGS. 1 through 5, and provides a single array of legs 81 diagonally connecting adjacent folds 82 and 83. In this instance, oppositely extending flanges 84 and 86 are formed along one side of the expanded metal web 87 and a bulb 88 is provided along the opposite edge. A grid tee of this type is of particular advantage in that the web of the grid tee is not subjected to any substantial stress, but functions primarily from a strength standpoint to merely hold the flanges and the bulb in a fixed position with respect to each other. Because the metal forming the web, however, is expanded, the material requirement for producing the entire grid tee is reduced substantially, thus reducing the manufacturing costs of the tee.

FIG. 11 illustrates a floor track in accordance with the present invention. In this embodiment, the floor track is again U-shaped, providing spaced and parallel flanges 91 and 92 interconnected by an expanded metal web 93. Here again, the web 93 is formed with a structure as illustrated and described in connection with the first embodiment of FIGS. 1 through 5. Such floor track is usually secured to the floor of a building prior to the installation of a drywall metal-studded wall system. In such an installation, the end of a stud, such as the stud illustrated in FIG. 1, extends between the flanges 91 and 92 and the wall panels are positioned with their ends outside of the flanges 91 and 92. Normally, such a floor track is secured to the floor structure by suitable fasteners which are driven through the web at intervals along the length of the track. Since the stud is secured to a floor structure, any lateral forces applied to the flanges in either direction are wellresisted because the floor itself assists in resisting bending of the web. Therefore, sufficient strength and stability are provided to support all forces normally encountered in such an installation.

FIG. 12 illustrates a wall molding for suspension ceilings having web 96 formed of expanded metal similar to the expanded metal of the embodiment of FIGS. 1 to 5. Such molding provides a lower flange 97 which supports the ends of grid tees and the adjacent edges of ceiling panels. An upper flange 98 is provided so that hold-down clips can be installed. Such a molding is usually installed with the web against the wall by driving fasteners through the web.

It should be noted that in each of the illustrated embodiments, the expanded metal is provided in the web section and that the flanges or bulbs extending along the opposite sides of the web are uninterrupted by the expanded metal lances. Such a structure is preferred in most instances because the junction between the edge portion, such as the flanges and the bulb, provides a bend extending in an uninterrupted manner. However, in some instances where structural requirements do not require such an interrupted bend, the lances can be formed in that portion of the material used to produce the product which is bent to provide a flange or bulb or other structural shape.

It should also be noted that even though it is preferred to expand the metal by the use of curved lances, it is within the broader scope of this invention to form the lances as V's so that the interconnecting legs are of a uniform width along all or substantially all of their lengths. Further, the material used to produce the expanded metal should be such that the folds, even when they are tightly folded through 180 degrees, do not rupture or weaken the material along such folds.

In accordance with the broader aspects of this invention, the expanded metal may be lanced and expanded and recoiled for shipping or storage. Subsequently, the expanded metal may be final-processed to produce the particular product in which the expanded metal is incorporated. Still further, although the curved lances in the illustrated embodiments are portions of circles, it is within the scope of this invention to choose other curved shapes, such as for example generally parabolic curved lances and the like.

Although the preferred embodiments of this invention have been shown and described, it should be understood that various modifications and rearrangements of the parts may be resorted to without departing from the scope of the invention as disclosed and claimed herein.

What is claimed is:

1. An expanded metal formed from a single piece of sheet metal comprising a first portion, a second portion, said portions being substantially coplanar, and an array of legs extending substantially along the plane of said first and second portions, said legs being connected at one end to said first portion by a tight fold and at the other end to said second portion by a tight fold, said legs at their ends providing overlapping portions engaging the adjacent part of said first and second portions to provide two engaging layers adjacent to each fold, said metal of said piece of sheet material being substantially undistorted during the expansion thereof except at said folds, whereby said expanded metal is relatively stable when subjected to stresses.

2. An expanded metal as set forth in claim 1, wherein alternate of said legs are substantially parallel and extend at an included angle less than 90 degrees with respect to the next adjacent leg.

3. An expanded metal as set forth in claim 2, wherein said legs between said folds have an average width at least equal to about one-third the distance between the adjacent ends of associated folds.

4. An expanded metal as set forth in claim 3, wherein said legs provide a maximum width at their centers and reduced width on each side of said centers.

5. An expanded metal as set forth in claim 4, wherein connecting means connect said two engaging layers at locations spaced from the associated folds, said connecting means resisting opening of said folds.

6. An expanded metal as set forth in claim 5, wherein said connecting means is an adhesive.

7. An expanded metal as set forth in claim 5, wherein said connecting means is provided by lance stitching said layers together.

8. An expanded metal as set forth in claim 1, wherein said legs between said folds have an average width at least about one-third the distance between adjacent ends of associated folds.

9. An expanded metal as set forth in claim 1, wherein said legs between said folds have an average width at least equal to about one-half the distance between adjacent ends of associated folds.

10. An expanded metal as set forth in claim 1, wherein said legs provide a maximum width at their centers and reduced width at each side of said centers.

11. An expanded metal as set forth in claim 1, wherein connecting means connect said two engaging layers at locations spaced from the associated folds, said connecting means resisting opening of said folds.

12. An expanded metal formed from a single piece of sheet metal comprising a first portion providing a first array including a first plurality of lateral projections, a second portion providing a second array including a second plurality of lateral projections, said lateral projections having curved edges, an array of legs connected to folds to alternate first and second projections, said legs having curved edges matching said curved edges of said projections, said metal of said piece of sheet metal being substantially undistorted during expansion thereof except at said folds.

13. An expanded metal as set forth in claim 12, wherein said expanded metal provides only one array of legs.

14. An expanded metal as set forth in claim 12, wherein said lateral projections have concave curved edges, and said legs have convex curved edges.

15. An expanded metal as set forth in claim 13, wherein said matching curved edges have a uniform radius of curvature.

16. An elongated sheet metal framing member for positioning interior surface building panels comprising a single piece of sheet metal providing a substantially planar web and a laterally extending flange operable to engage and position a surface panel, said flange being joined to a lateral edge of said web along a bend, said web providing a first longitudinal portion providing a plurality of laterally extending longitudinally spaced first projections extending in a direction away from said flange and a second longitudinally extending portion providing a plurality of laterally extending longitudinally spaced second projections extending toward said flange, and a plurality of diagonal legs joined at one end to associated first projections by first folds and at their other ends to associated second projections by second folds, said projections and legs providing overlapping portions adjacent to said folds, said overlapping portions providing two layers of metal in face-to-face engagement, said legs and projections being substantially coplanar, said flange when subjected to a force applied thereto in a direction substantially parallel to and spaced from one side of the plane of said web causing bending stresses in said first projections.

17. A framing member as set forth in claim 16, wherein said overlapping portions of said legs operate to resist opening of said first folds when said stress is applied to said first projections.

18. A framing member as set forth in claim 16, wherein said framing member is a wall stud, said wall stud providing a second flange joined at a bend to the opposite lateral edge of said web.

19. A framing member as set forth in claim 18, wherein said legs provide convex curved edges and have a maximum width substantially at their center.

20. A framing member as set forth in claim 19, wherein said web provides only a single array of legs.

21. A framing member as set forth in claim 18, wherein said web provides only a single array of legs.

22. A framing member as set forth in claim 16, wherein said framing member is a grid tee for suspension ceilings, said grid tee providing a stiffening bulb along the side of said web opposite said flange.

23. A framing member as set forth in claim 22, wherein said sheet metal forming said bulb and said flange is spaced from said projections.

24. A framing member as set forth in claim 16, wherein said web provides a plurality of lengthwise arrays of legs, said legs and projections providing curved edges.

25. A framing member as set forth in claim 24, wherein said curved edges are portions of circles.

26. A sheet metal U-shaped elongated framing member for positioning interior surface building panels comprising an expanded metal substantially planar web and a pair of laterally extending flanges connected to opposite lateral edges of said web, said member being formed of a single piece of sheet metal, said web providing a plurality of diagonal legs connected by folds at their ends to adjacent portions of said web, said legs providing overlapping portions overlapping said adjacent portions of said web and providing two layers adjacent said folds in face-to-face engagement, said engagement of said overlapping portions resisting opening of said folds in at least one direction when bending stresses are applied to said web.

27. A framing member as set forth in claim 26, wherein said legs provide curved edges.

28. A framing member as set forth in claim 27, wherein said legs are widest at their centers.

29. A framing member as set forth in claim 28, wherein said curved edges have a uniform radius of curvature.

30. A framing member as set forth in claim 26, wherein said legs have an average width at least equal to one-third the distance between adjacent ends of associated folds.

31. A framing member as set forth in claim 26, wherein adjacent legs are angulated relative to each other with an included angle less than 90 degrees.

32. A sheet metal stud comprising a pair of substantially parallel flanges interconnected by a planar web, said web including an expanded portion separated from the remaining portions of said sheet metal except along a plurality of first aligned folds and a plurality of second aligned folds, wherein said first and second folds extend along spaced and parallel lines, said expanded metal portion providing angled legs joining said first folds to adjacent second folds, said folds being tightly closed to position said legs and the adjacent portions of said web substantially coplanar, whereby said expanded metal portion is sufficiently stable to support compression and bending loads normally encountered.

33. A building wall structure comprising a sheet metal stud, said stud being formed from a single piece of sheet metal providing a web and substantially parallel flanges extending laterally from opposite sides of said web, wall panels secured to said flanges, said web including an expanded portion providing diagonal legs joined at their ends to adjacent portions of said web by reverse bends, said legs providing overlapping portions overlapping said adjacent portions adjacent to said folds, said legs having convex curved edges and a maximum width substantially at the longitudinal center of said stud.

34. A method of producing expanded metal comprising lancing a strip of sheet metal with first and second arrays of aligned similarly curved lances, the ends of said curved lances in each array being spaced from each other in the direction of said alignment and being located within and spaced from the curved lances of the other array, and expanding said sheet metal by rotating the portion between said lances thereof through substantially 180 degrees with respect to the adjacent remaining portions of said sheet metal to provide curved legs joined to said adjacent portions of said sheet metal by folds, said folds being sufficiently closed to position said legs and said adjacent portions substantially along a plane, said legs providing a maximum width substantially at their centers and providing said expansion without material deformation of said metal except at said folds.

* * * * *